United States Patent [19]

Kurtz

[11] Patent Number: 4,839,663

[45] Date of Patent: Jun. 13, 1989

[54] DUAL POLARIZED SLOT-DIPOLE RADIATING ELEMENT

[75] Inventor: Louis A. Kurtz, Woodland Hills, Calif.

[73] Assignee: Hughes Aircraft Company, Los Angeles, Calif.

[21] Appl. No.: 933,453

[22] Filed: Nov. 21, 1986

[51] Int. Cl.[4] ..... H01Q 13/10

[52] U.S. Cl. ..... 343/771; 343/770; 343/727; 343/767

[58] Field of Search ..... 343/770, 771, 772, 767, 343/725, 727

[56] References Cited

U.S. PATENT DOCUMENTS

| | | | |
|---|---|---|---|
| 2,908,905 | 10/1959 | Saltzman | 343/771 |
| 3,503,073 | 3/1970 | Ajioka | 343/771 |
| 3,524,189 | 8/1970 | Jones | 343/771 |
| 3,594,806 | 7/1971 | Black | 343/771 |

FOREIGN PATENT DOCUMENTS

| | | | |
|---|---|---|---|
| 1573604 | 8/1980 | United Kingdom | 343/771 |

*Primary Examiner*—William L. Sikes
*Assistant Examiner*—Hoanganh Le
*Attorney, Agent, or Firm*—R. A. Hays; A. W. Karambelas

[57] ABSTRACT

Two contiguous half-height waveguides (12, 14) having a common broad wall (16) are provided with a pair of closely spaced equal length slots (20) and a single unbalanced-fed half-wave dipole (24) located parallel to and between the slots, with feed line coupled to the waveguide walls between the slots and provides for both longitudinal and transverse polarization. When the waveguides are excited in phase (even mode), the slots radiate similar to a single shunt slot with a longitudinal polarization. When the waveguides ae excited out of phase (an odd mode), the dipole is the primary radiator, radiating energy in a transverse polarization.

22 Claims, 3 Drawing Sheets

DUAL POLARIZED SLOT-DIPOLE RADIATING ELEMENT

BACKGROUND OF THE INVENTION

1. Field of the Invention

The present invention relates generally to microwave antennas and, more particularly, to a waveguide fed antenna which can produce independent, selectable transverse and longitudinal polarizations. The invention is useful in providing polarization control in antenna arrays.

2. Description of Related Art

In antenna array applications for microwave communications and radar applications, for example, it is desirable to be able to control the polarization of the antenna with respect to the longitudinal and transverse planes. In a waveguide slot array antenna, it is often impractical to move or tilt the radiating elements. Hence, the radiation polarization must be controlled by controlling the phase and/or amplitude of the excitation energy being delivered to each of two orthogonal sets of radiating elements. In waveguide slot array antennas, the radiating elements are in the form of slots or apertures positioned at spaced intervals (usually a half waveguide wavelength apart). In some waveguide array designs, a plurality of such slotted waveguides are stacked with their respective slotted walls in a common plane to define a two-dimensional matrix configuration.

With such slot array antennas of the prior art, it has been difficult to select between longitudinal and transverse polarization (perpendicular to the waveguide length). The slots which comprise such arrays naturally produce a linear polarization which aligns with the transverse dimension of the slot. Thus, a prior art slot array of conventional configuration produces primarily a single polarization, dictated by the orientation of the slots.

One possible technique for providing dual polarization is described in U.S. Pat. No. 3,503,073 to Ajioka, entitled "Two-Mode Waveguide Slot Array", which is assigned to the assignee of the present invention. That technique employs a waveguide which includes an internal septum wall extending partially across the interior of the waveguide and which has a plurality of non-resonant crossed slots. This prior art configuration is best used in traveling wave-fed arrays, where the susceptance of the non-resonant slots is tolerable. This technique is not well suited for standing wave-fed arrays, such as flat plate antenna arrays, however. Another disadvantage of the crossed-slot configuration is that the required dimensions of the slots limit the element spacing in the transverse plane to something larger than could be achieved with parallel slots (non-crossed slots). The ability to closely space the aperture elements is desirable since it allows a wider scan angle to be achieved before grating lobes appear.

SUMMARY OF THE INVENTION

The present invention provides an antenna configuration offering dual polarization. The antenna comprises two contiguous waveguides having a common wall. One or more pairs of closely spaced parallel slots are located in the coplanar sidewalls of the respective waveguides and an unbalanced-fed half-wave dipole element is located parallel to and between the slots, above the coplanar waveguide walls. Either transverse or longitudinal polarization can be readily selected by simply exciting the slot pairs in phase (even mode) or out of phase (odd mode). In the even mode excitation, the slot pairs radiate as a single longitudinal shunt slot and the half-wave dipole has little effect on the radiation pattern. When odd mode excitation is selected, the dipole radiates in cross polarization relative to the slots.

Preferably, the contiguous waveguides are half-height waveguides having a common broad wall, thereby affording a compact antenna array. The short, non-resonant longitudinal slots can be matched to zero susceptance by a single inductive iris positioned in each waveguide. In this fashion, a real conductance is achieved as required in a standing wave array to control amplitude of the aperture distribution and to achieve an input impedance match at the design frequency. Matching the susceptance is also advantageous for traveling wave array designs. The slots present similar shunt loading for both even and odd mode excitation of the waveguides. This simplifies phase control in the array design. Furthermore, the parallel closely spaced slots allow thinner waveguides to be used. This reduces the slot spacing in the transverse plane and helps reduce grating lobes, while at the same time allowing a greater beam scan in the transverse plane before grating lobes appear in the pattern.

The invention thus provides an antenna capable of producing independent, selectable transverse or longitudinal polarization from a waveguide-fed radiating element which can be used in a flat plate-type antenna. The uses of the invention are many, including flat-plate antennas in weather radars and fire control radars, where the polarization (vertical, horizontal, RHCP or LHCP) can be chosen for the best results in a particular situation. The invention is also useful for providing polarization diversity in flat-plate arrays for communication satellites. Variable polarization is also useful in evaluating target echo characteristics in radar systems or in countering cross-polarized jamming interference.

Still further in accordance with the invention, there is provided a method of radiating electromagnetic energy comprising using a pair of contiguous waveguides having a common wall and each having a non-resonant slot therein. The slots are positioned adjacent to one another and have mutually parallel longitudinal axes. The method further comprises using a dipole radiating means disposed adjacent the slots and extending generally parallel to the longitudinal axes of the slots. The method comprises selectively exciting the waveguides in a first mode of excitation, causing the slots to radiate electromagnetic energy in a transverse polarization. The method further comprises selectively exciting the waveguides in a second mode of excitation causing the dipole to radiate electromagnetic energy in a longitudinal polarization.

For a more complete understanding of the invention, its objects and advantages, reference may be had to the following specification and to the accompanying drawings.

DESCRIPTION OF THE PREFERRED EMBODIMENT

Figure 1A:
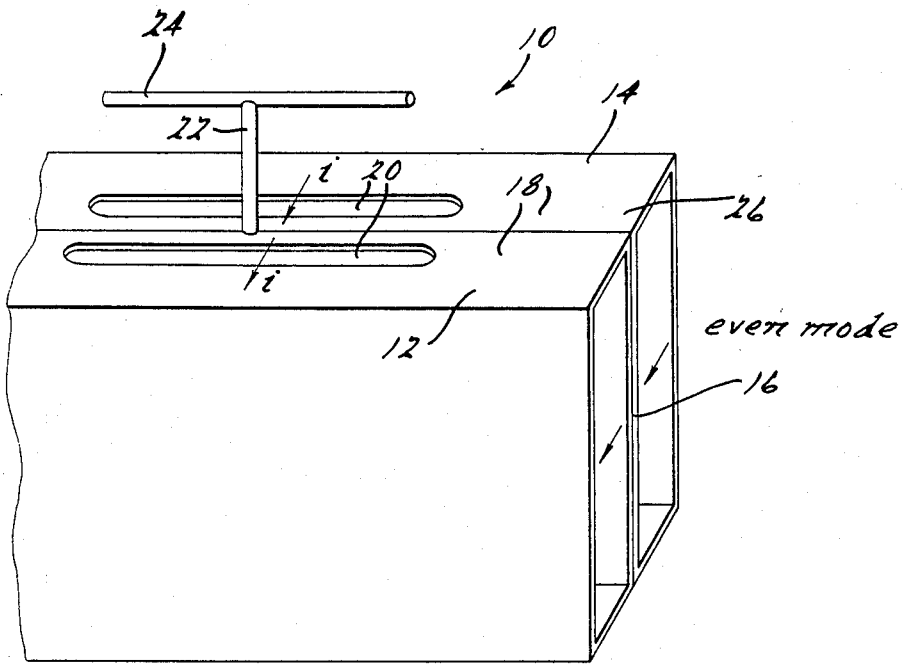
FIG. 1A is a perspective view of the dual polarized slot-dipole radiating element of the invention in an even mode excitation.
Figure 1B:
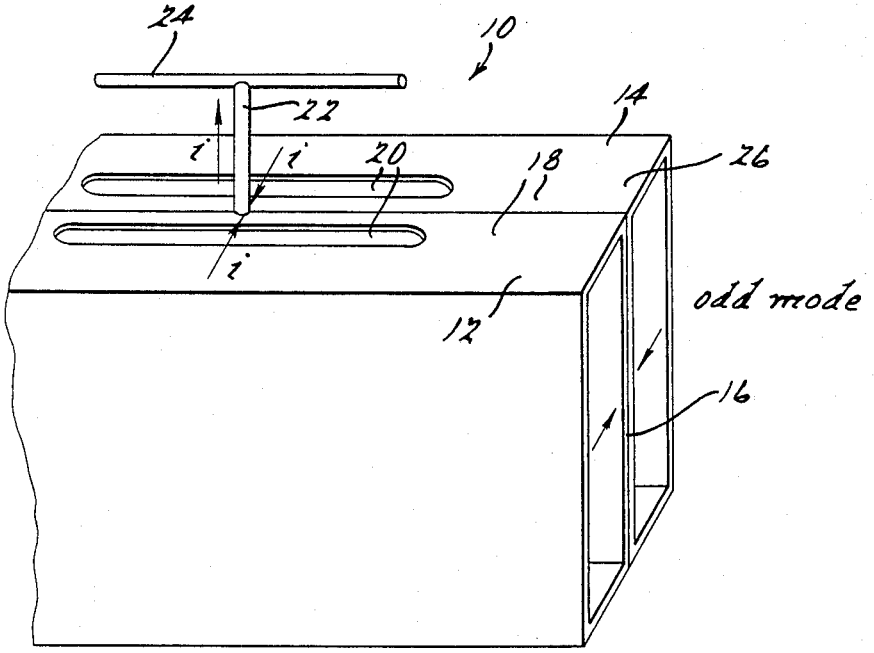
FIG. 1B is similar to that of FIG. 1A, illustrating the radiating element in an odd mode excitation.

Referring to FIGS. 1A and 1B, the dual polarized slot-dipole radiating element is illustrated generally at 10. The radiating element is formed in conjunction with two contiguous waveguides 12 and 14 which share a common broad wall 16. Preferably, waveguides 12 and 14 are half-height waveguides and are joined together at their respective broad walls 16 for good electrical conductivity. In the alternative, waveguides 12 and 14 may be fabricated as a single bifurcated waveguide having the same general configuration illustrated in FIGS. IA and IB.

Waveguides 12 and 14 have coplanar side walls 18 which lie in and define the plane of the antenna. Formed in side walls 18 is a pair of slots 20. Slots 20 are elongated in the longitudinal dimension of the waveguides and are preferably of a non-resonant length. Preferably, slots 20 are spaced as closely as physically practicable, so that the pair behaves as a single radiating aperture. Electrically coupled to and positioned centrally between slots 20 is the feed line 22 of dipole radiating element 24. Dipole element 24 is preferably a half-wave dipole located parallel to and between slots 20. Dipole 24 is preferably equally spaced from both slots and positioned up to one-quarter wavelength above the waveguide side walls 18. Preferably, feed line 22 couples with dipole 24 at the appropriate impedance point along its length so that the dipole has approximately the same impedance to electromagnetic energy in the waveguides as the impedance of the slots. For a half-wave dipole, the proper feed point is in an intermediate position between the center of the dipole and one of the ends.

In order to understand how the radiating element works, the radiating elements of FIGS. 1A and 1B will be considered in a transmitting condition in which electromagnetic energy is fed into the waveguides for radiation via the slots and dipole. In accordance with the principles of reciprocity, the radiating elements of FIGS. 1A and 1B perform similarly when used to receive electromagnetic energy via the slots and dipole for subsequent propagation through the waveguides. FIG. 1A illustrates excitation in the even mode. As used herein, even mode is characterized by exciting both waveguides in phase. When the waveguides are excited in phase, the two parallel slots 20 behave as shunt slot radiators and radiate electromagnectic energy in phase with a transverse polarization. Current flow, indicated by reference character i, is induced in the same direction for both slots. Since the slots are close together, their combined radiation pattern is like that of a single slot over most of the hemispherical space above the ground plane 26 containing the slots. This ground plane is formed when many such waveguides are stacked together in a planar array with the respective side walls 18 lying in and forming the ground plane. In this mode of excitation, there is no tendency for excitation of the dipole 24, nor does the dipole interfere with the slot radiation because it is perpendicular to the electric fields of the slots.

With reference to FIG. 1B, a different radiation pattern results when the waveguides are excited in an odd mode. As used herein, the odd mode is characterized by exciting the waveguides 180° out of phase with each other. The radiation from the two slots cancel each other over most of the hemisphere in front of ground plane 26. However, the current flow in the waveguide walls, denoted by reference character i, is in opposite directions for each slot and thus the current flow tends to follow feed line 22 to provide excitation of the dipole 24, much in the same way as in the base excitation of a monopole. The resonant half-wave dipole is excited at the appropriate impedance point along its length and it radiates into the hemispherical space in front of ground plane 26. The dipole polarization is perpendicular to that of the slots, and there is little interaction between the dipole and the slots of the given radiating element 10. In the odd mode excitation, the dipole, rather than the slots, radiates electromagnetic energy and this radiation is in a longitudinal polarization.

Thus, the radiated polarization from the combination of two parallel slots plus the unbalanced-fed dipole can be changed from transverse to longitudinal (i.e. vertical to horizontal) by merely changing the phase of excitation by 180° in one of the two waveguides 12 and 14.

The two parallel slots couple to the bifurcated waveguide (waveguides 12 and 14) to a degree that depends on the length of the slots. In a multi-slot array, several pairs of slots are positioned at periodic intervals along the length of the waveguides. Preferably, the pairs of slots may be spaced at one wavelength apart in order to ensure that all radiating elements are in phase. Of course, the slots can be positioned at other spacings if appropriate for the design desired. In order to control the field distribution across the overall array aperture, successive pairs of slots can be made of different lengths, preferably shorter slots on the ends gradually becoming longer toward the center of the bifurcated waveguide structure.

Figure 2:
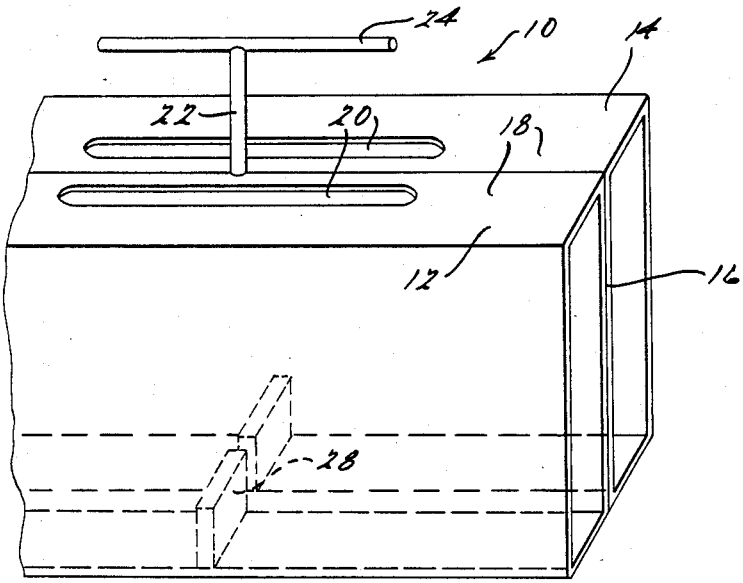
FIG. 2 is a perspective view illustrating the use of an inductive iris for matching the slot susceptance.

In order to further control the coupling of the parallel slots to the bifurcated waveguide structure, a matching inductive iris can be employed. With reference to FIG. 2, matching irises 28 are illustrated, positioned in the narrow wall or side wall opposite a given pair of slots. A normalized conductance appropriate to a chosen design can be achieved by adjusting the slot length. There will be a corresponding normalized susceptance which can be reduced to zero by the appropriate height irises 28. Thus a real conductance is achieved as required in a standing wave array to control amplitude of the aperture distribution and achieve an input impedance match at the desired frequency. Susceptance matching of the radiating elements is also advantageous for traveling wave array designs.

Figure 3:
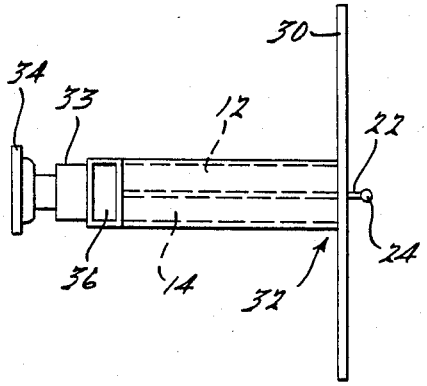
FIG. 3 is a side view of an exemplary slot-dipole element test fixture useful in understanding the invention.
Figure 4:
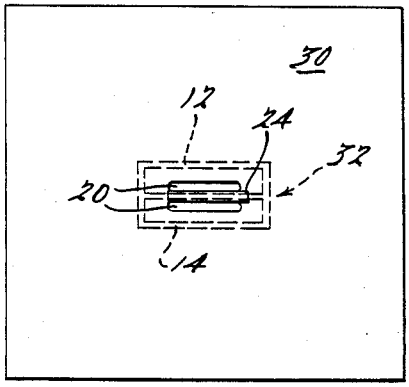
FIG. 4 is a frontal view of the test fixture of FIG. 3.
Figure 5:
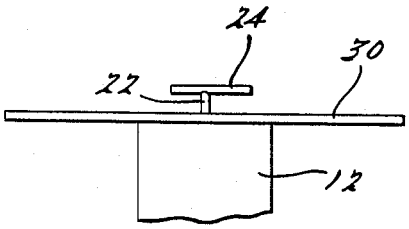
FIG. 5 is a side view orthogonal to that of FIG. 3.

While the slot-dipole radiating element of the invention is well adapted for aperture array antennas where the slot is positioned in the side wall of the waveguide, other configurations with nonresonant or resonant slots are also possible without departing from the scope of the invention. For example, FIGS. 3, 4 and 5 illustrate a single pair of resonant slots 20 and dipole 24 which are fashioned in and connected to a metal plate 30 which defines the antenna ground plane. A pair of contiguous waveguides 12 and 14 are coupled at end 32 to the ground plane plate 30, so that the interior of waveguide 12 communicates with one of the slots 20 while the interior of waveguide 14 communicates with the other of the slots 20. Dipole 24 is coupled to plate 30 by feedline 22. No irises are required for resonant slots have zero susceptance. In order to provide either even mode or odd mode excitation, an E-plane folded magic tee 33 is connected to the opposite end of the waveguides. The magic tee 33 includes an even mode port 34 and an odd mode port 36 into which the appropriate excitation energy may be fed. Table I below compares the slot impedance (even mode input) with the dipole impedance (odd mode input) for a range of microwave frequencies. As will be seen studying the Table, the impedances are quite comparable between even mode and odd mode.

TABLE I

| Frequency MHz | Slot Impedance (even mode input) | Dipole Impedance (odd mode input) |
|---|---|---|
| 9100 | 1.44 + j.40 | 1.31 + j.62 |
| 9150 | 1.48 + j.31 | 1.35 + j.56 |
| 9200 | 1.48 + j.22 | 1.36 + j.51 |
| 9250 | 1.48 + j.17 | 1.37 + j.44 |
| 9300 | 1.49 + j.09 | 1.37 + j.38 |
| 9350 | 1.50 − j.04 | 1.37 + j.36 |
| 9400 | 1.47 − j.10 | 1.38 + j.38 |
| 9450 | 1.42 − j.16 | 1.45 + j.36 |
| 9500 | 1.43 − j.20 | 1.49 + j.29 |

Figure 6:
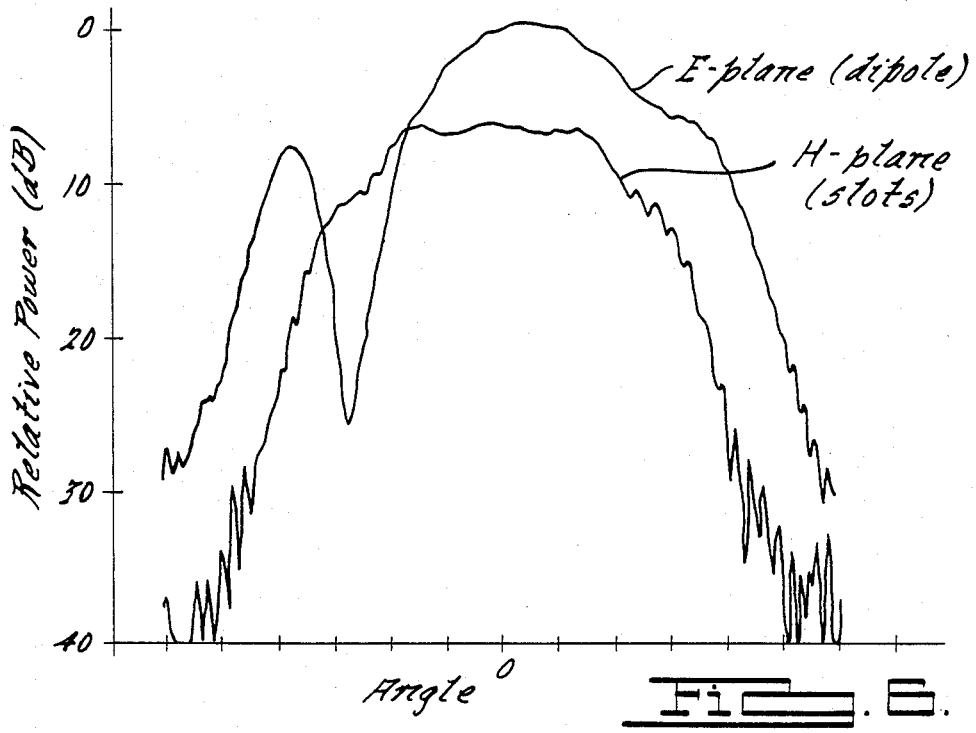
FIG. 6 is a graph illustrating the radiation patterns parallel to the slots.
Figure 7:
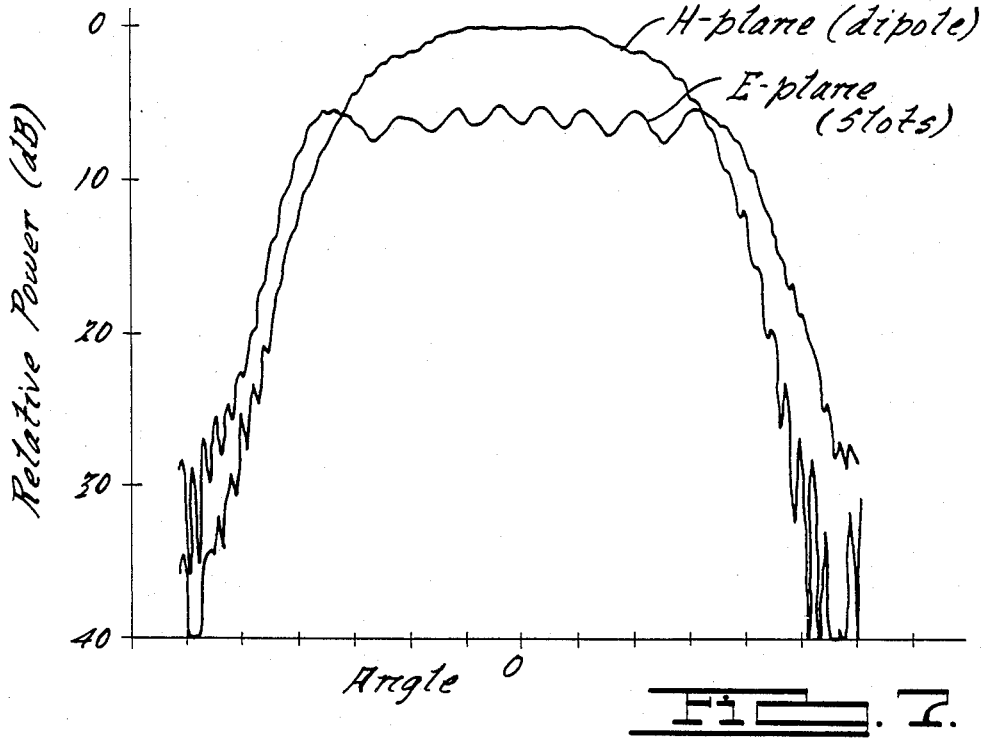
FIG. 7 is a similar graph illustrating the radiation patterns perpendicular to the slots.

FIGS. 6 and 7 illustrate the measured radiation patterns of the slot-dipole radiating element of the test fixture of FIGS. 3, 4 and 5. FIG. 6 depicts the radiation patterns parallel to the slots, giving both the E-plane pattern of dipole 24 and the H-plane of slots 20. For comparison FIG. 7 gives the radiation patterns perpendicular to the slots, showing the H-plane pattern of the dipole and the E-plane pattern of the slots. These radiation patterns demonstrate that comparable radiation patterns are achieved in both longitudinal (parallel) and transverse (perpendicular) orientations.

The gain of the dipole is higher than the gain of slots in a ground plane, as demonstrated in FIGS. 6 and 7. The null in the dipole pattern can be modified by changes in the dipole design. As is, however, the patterns would be suitable for a narrow beam array design. The measured values of input impedance for the two polarizations shown in Table I, although already quite close, could be made more nearly equal by fine tuning the dipole feed point.

While the foregoing has described the invention in its presently preferred form, it will be understood that the invention is adaptable to many different applications and is capable of certain modification and change without departing from the spirit of the invention as set forth in the appended claims.

What is claimed is:

1. A method of radiating dual polarized electromagnetic energy, comprising:

using a pair of contiguous waveguides having a common wall and each having a non-resonant slot therein, said slots being positioned adjacent to one another and having mutually parallel longitudinal axes;

using a dipole radiating means disposed adjacent and parallel with said slots;

selectively exciting said waveguides in a first mode of excitation causing said slots to radiate electromagnetic energy in a transverse polarization; and selectively exciting said waveguides in a second mode of excitation causing said dipole to radiate electromagnetic energy in a longitudinal polarization.

2. The method of claim 1 further comprising positioning an inductive iris in each said waveguides to adjust the susceptance of said slots.

3. The method of claim 1 wherein said dipole is an unbalanced-fed half-wave dipole.

4. The method of claim 1 wherein said first mode of excitation is provided by exciting both waveguides in phase.

5. The method of claim 1 wherein said second mode of excitation is provided by exciting both waveguides out of phase.

6. The method of claim 1 wherein said second mode of excitation is provided by exciting both waveguides 180° out of phase.

7. The method of claim 1 wherein said waveguides are half-height waveguides.

8. The method of claim 1 wherein said dipole radiating means is disposed not greater than one-quarter wavelength from said waveguides.

9. The method of claim 1 further comprising disposing said slots in a ground plane.

10. The method of claim 1 further comprising stacking a plurality of waveguides in a planar array.

11. The method of claim 1 further comprising selectively exciting said waveguides in either of said first and second modes using a tee waveguide.

12. The method of claim 11 wherein said tee waveguide is an E-plane folded magic tee.

13. The method of claim 1 further comprising using said longitudinally polarized energy and said transversely polarized energy to provide a variable polarization signal for evaluating radar target echo characteristics.

14. The method of claim 1 further Comprising using said longitudinally polarized energy and said transversely polarized energy to provide a variable polarization signal for countering cross-polarized interfering signals.

15. An antenna system for radiating dual polarized electromagnetic energy comprising:

a pair of contiguous waveguides, each said waveguide having a non-resonant slot in one wall thereof, said slots being coplanar having mutually parallel longitudinal axes said slots being disposed in such proximity to each other that when said waveguides are excited in a first mode of excitation said slots radiate electromagnetic energy in a transverse polarization as a single radiating aperture; and a dipole radiating means, said dipole radiating means being disposed substantially equidistant from and parallel with said longitudinal axes of said slots, said dipole radiating means being coupled to said waveguides between said slots by a feedline such that, when said waveguides are excited in a second mode of excitation said dipole radiating means radiates electromagnetic energy in a longitudinal polarization.

16. The apparatus of claim 15 further comprising at least one inductive iris positioned in each of said waveguides for adjusting the susceptance of said slots.

17. The apparatus of claim 15 wherein said waveguides are half-height waveguides.

18. The apparatus of claim 15 wherein said dipole is disposed not greater than one quarter wavelength from said waveguides.

19. The apparatus of claim 15 further comprising a plurality of said pairs of waveguides, each said pair having one said dipole substantially equidistant from and parallel with said longitudinal axes of said slots, said waveguides being stacked in a planar array.

20. The apparatus of claim 15 further including tee waveguide means for selectively exciting said waveguides in either of said first and second modes.

21. The apparatus of claim 20 wherein said tee waveguide is an E-plane folded magic tee.

22. The apparatus of claim 15 wherein said dipole radiating means is a half-wave dipole having a feed point intermediate the center of said dipole and one of the ends thereof.

* * * * *